US005597673A

United States Patent [19]

Watanabe et al.

[11] Patent Number: 5,597,673

[45] Date of Patent: Jan. 28, 1997

[54] TONER FOR DEVELOPING ELECTROSTATIC LATENT IMAGE

[75] Inventors: Kazuhito Watanabe, Numazu; Toshiki Nanya, Mishima, both of Japan

[73] Assignee: Ricoh Company, Ltd., Tokyo, Japan

[21] Appl. No.: 522,929

[22] Filed: Sep. 1, 1995

[30] Foreign Application Priority Data

Sep. 2, 1994 [JP] Japan ..... 6-234325

[51] Int. Cl.[6] ..... G03G 9/087; G03G 9/09; G03G 9/097

[52] U.S. Cl. ..... 430/96; 430/106; 430/110

[58] Field of Search ..... 430/96, 106, 110

[56] References Cited

U.S. PATENT DOCUMENTS 4,624,907 11/1986 Niimura et al. ..... 430/106
4,842,975 6/1989 Kato et al. ..... 430/114
5,059,505 10/1991 Kashihara et al. ..... 430/110
5,439,770 8/1995 Taya et al. ..... 430/106

*Primary Examiner*—Roland Martin
*Attorney, Agent, or Firm*—Oblon, Spivak, McClelland, Maier & Neustadt, P.C.

[57] ABSTRACT

A toner comprising a binder resin, a colorant, and a charge controlling agent comprising (a) a specific iron-containing azo dye and (b) a copolymer of a styrene monomer and/or an acrylic monomer with a sulfonic acid group-containing acrylamide, wherein the amount of the azo dye present on the surface of the toner is $7\times10^{-3}$ to $20\times10^{-3}$ g per 1 g of said toner. The toner is suitably used in conjunction with carrier particles, each having a surface layer containing a silicone resin, electroconductive particles and a silane coupling agent.

8 Claims, 1 Drawing Sheet

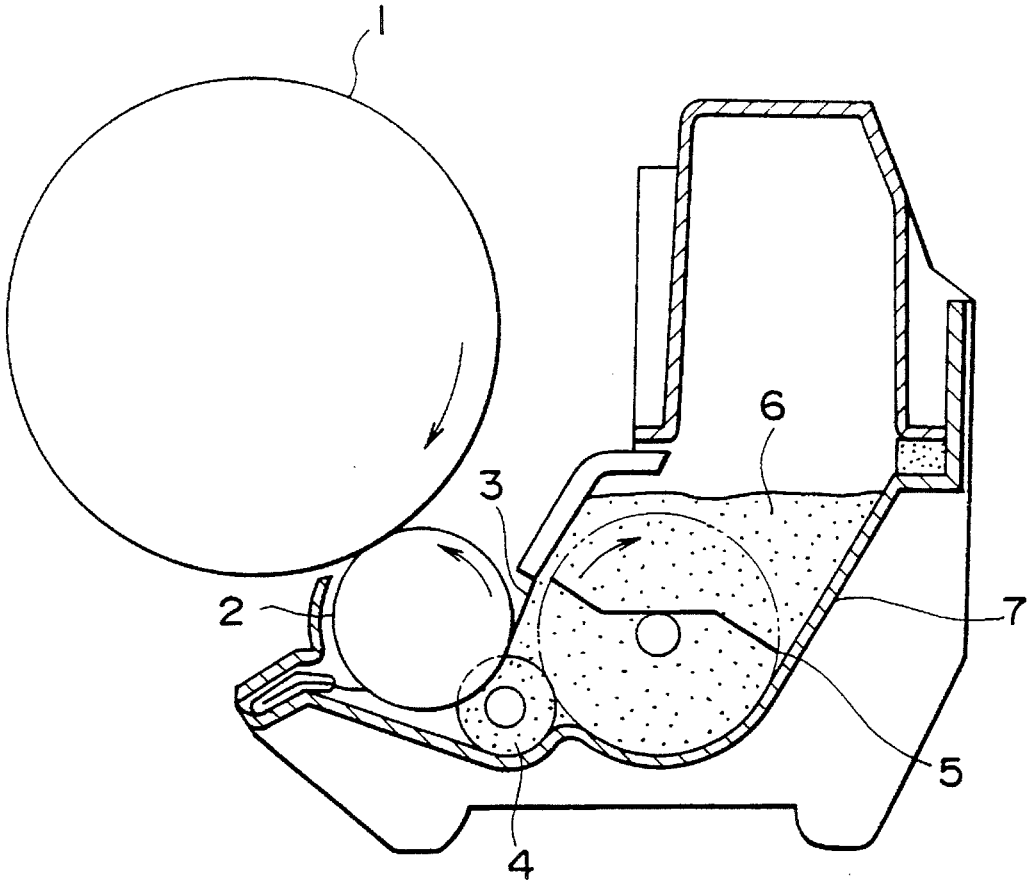
1
2
3
4
5
6
7

TONER FOR DEVELOPING ELECTROSTATIC LATENT IMAGE

BACKGROUND OF THE INVENTION

1. Field of the Invention

This invention relates to a toner used in electrophotograpy and electrostatic printing for developing an electrostatic latent image. The present invention also pertains to a two-component type, negatively chargeable developer containing a toner and a carrier.

2. Description of Prior Art

Methods for developing an electrostatic latent image into a toner image include a first method using a one-component type developer composed only of a toner and a second method using a two-component type developer composed of a toner and a carrier which are charged in opposite polarity.

The one-component type method may be, for example, a powder cloud developing method in which toner particles are sprayed over an electrostatic latent image-bearing surface, a contact developing method (touch down method) in which a latent image-bearing surface is directly contacted with a bed of toner, or a dielectric developing method in which a latent image-bearing surface is contacted with a magnetic, electrically conductive toner.

The two-component type method may be, for example, a magnet brush method using iron powder as a carrier, a cascade method in which glass beads are used as a carrier or a fur brush method in which a fiber brush is used as a carrier.

In the above developing systems, fine particles each composed of a matrix of a binder resin and a colorant, such as carbon black, dispersed in the matrix are generally used as a toner. To obtain clear images, a charge controlling agent is usually used. Known charge controlling agents include metal complexes of monoazo dyes; metal complexes of salicylic acid, naphthoic acid or a dicarboxylic acid; sulfonated copper phthalocyanine pigments; and nitrified or halogenated styrene oligomers; chlorinated paraffins; and melamine resins.

The known charge controlling agents suffer from one or more of the following defects and are not fully satisfactory. Thus, the conventional charge controlling agents are apt to be decomposed or deteriorated upon subjected to mechanical impact, heat or moisture to cause a change of the charging characteristics of the toner during use. In addition, a so-called filming phenomenon (formation of a film of the toner on surfaces of the photosensitive medium, blade and/or carrier) is caused upon repeated copying operations. Further, the conventional charge controlling agents are not easily uniformly distributed in respective toner particles to cause fogging of the copies.

In the two-component developer, relatively small particle size toner particles are electrostatically held on surfaces of relatively large particle size carrier particles. In development, the toner particles migrate to an electrostatic image against the attractive force of the carrier particles. Fresh toner particles are again held on the carrier particles by frictional electrification. During repeated use, however, a filming phenomenon is caused so that it is necessary to entirely replace the spent developer.

To minimize such filming of a toner on carrier particles, it is proposed to coat each carrier particle with a silicone resin. The silicone resin coat is, however, apt to be separated from the surfaces of the carrier upon subjected to mechanical shocks during use to cause a variation of charges of the developer. Additionally, a high electrical resistance of the silicone resin coat results in the local accumulation of charges so that the quality of developed images is deteriorated. To cope with this problem, it is proposed to incorporate an electrically conductive substance such as carbon or tin oxide into the silicone resin layer. This is not, however, effective to prevent the separation of the surface coating from the carrier. Further, the electrically conductive substance is apt to be separated from the coated layer.

SUMMARY OF THE INVENTION

It is, therefore, an object of the present invention to provide a toner which can develop clear electrostatic images in a stable manner and which can be used in both one-component-type and two-component-type developing system.

Another object of the present invention is to provide a toner which can give good toner images even after repeated continuous copying operations.

It is a further object of the present invention to provide a toner which provides stable frictional charging between toner particles, between the toner and a carrier and between the toner and electrostatically chargeable parts of an image developing section such as a sleeve and a blade.

It is a further object of the present invention to provide a toner of the above-mentioned type which can very rapidly accumulate charges, which can provide uniformly and narrowly distributed electric charges and which can provide optimum charges according to the developing system adopted.

It is yet a further object of the present invention to provide a toner which permits the fixation of toner images at a relatively low temperature.

It is a special object of the present invention to provide a two-component-type developing composition which is free of background fouling, toner dispersion, deterioration of developed images due to an edge phenomenon or accumulation of charges, separation of a coated layer from the carrier, or separation of electroconductive particles from the carrier.

It is a further object of the present invention to provide a two-component-type developing composition whose frictional electrification is stable for a long service time so that high fidelity images are obtainable even after repeated continuous copying operations.

In accomplishing the foregoing object, the present invention provides a negatively chargeable toner for developing an electrostatic image, which comprises a binder resin, a colorant, and a charge controlling agent including (a) an iron-containing azo dye expressed by the following general formula (I):

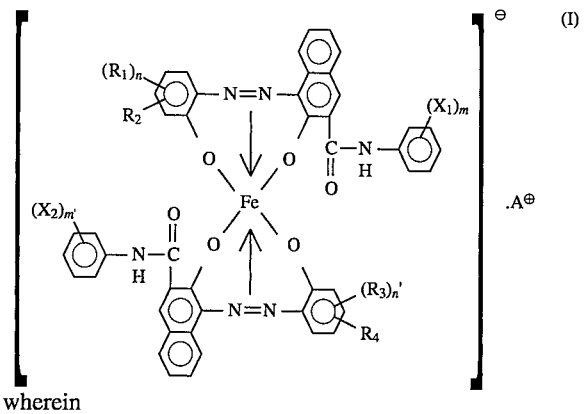

(I)

wherein $X_1$ and $X_2$ are independently a hydrogen atom, a lower alkyl group, an alkoxy group, a nitro group or a halogen atom, $R_1$ and $R_3$ are independently a hydrogen atom, an alkyl group having 1–18 carbon atoms, an alkenyl group, a sulfonamide (sulfamoyl) group, an organic sulfonyl group, a carboxylic acid ester (alkoxycarbonyl) group, a hydroxyl group, an alkoxy group having –18 carbon atoms, an acetylamino group or a halogen atom, $R_2$ and $R_4$ are independently a hydrogen atom or a nitro group, $A^+$ stands for a cation, and m, m', n and n' are each an integer of 1–3, and (b) a copolymer of a styrene monomer and/or an acrylic monomer with a sulfonic acid group-containing acrylamide, wherein the amount of said azo dye present on the surface of said toner is $7\times10^{-3}$ to $20\times10^{-3}$ g per 1 g of said toner.

It is important that the iron-containing azo dye (a) should be used in conjunction with the copolymer (b) as the charge controlling agent according to the present invention. When the azo dye (a) is used by itself, it is impossible to obtain a satisfactory amount of saturation electric charges and, further, a carrier is considerably fouled with the azo dye (a) upon repeated use. When the copolymer (b) is used by itself as the charge controlling agent, a fatigue is often caused during repeated continuous copying operations because of slow electrification speed thereof, although a satisfactory amount of saturation electric charges is obtainable.

The conjoint use of the azo dye (a) with the copolymer (b) also permits the use of a polyester resin or an epoxy resin as the binder of the toner, so that the fixation of the toner images can be carried out at a relatively low temperature.

It is also important that the amount of the iron-containing azo dye present on the surface of the toner should be $7\times10^{-3}$ to $20\times10^{-3}$ g per 1 g of the toner. An amount of the azo dye (a) below $7\times10^{-3}$ g/g is insufficient to provide a satisfactory charge collecting time. Too large an amount of the azo dye (a) in excess of $20\times10^{-3}$ g/g, on the other hand, causes the fouling of a carrier with the charge controlling agent.

The term "amount of the iron-containing azo dye present on the surface of the toner" used herein is defined by the ratio of the weight of the iron-containing azo dye, relative to the weight of the toner, dissolved in methanol when the toner and the methanol are mixed with each other, and is measured by the following method:

Toner (100 mg) and methanol (50 ml) are mixed with a ball mill for 10 minutes at 20° C. The ball mill is a table ball mill having a rotatable, cylindrical glass vessel having an inside diameter of 35 mm and an inside length of 100 mm and containing 20 pieces of glass beads each having a diameter of 5 mm. The ball mill is operated at a rotational speed of 200 rpm. The mixture is then allowed to quiescently stand at 20° C. for 24 hours. The supernatant is measured for the concentration of the azo dye by an absorption spectrophotometer. The concentration is determined according to the Lambert-Beer's law.

The term "amount of the iron-containing azo dye present on the surface of the toner" is hereinafter referred to simply as "azo dye content $C_A$".

In another aspect the present invention provides a developing composition of a two-components-type which comprises the above toner as the first component, and carrier particles as the second component, wherein each of the carrier particles has a surface layer containing a silicone resin, electroconductive particles and a silane coupling agent.

BRIEF DESCRIPTION OF THE DRAWING

Other objects, features and advantages of the present invention will become apparent from the detailed description of the preferred embodiments of the invention which follows, when considered in light of the accompanying drawing in which the sole FIGURE is a cross-sectional, elevational view diagrammatically showing a developing section of a copying machine.

DETAILED DESCRIPTION OF THE PREFERRED EMBODIMENTS OF THE INVENTION

The important feature of the present invention resides in the use of the iron-containing azo compound (a) of the above formula (I) in conjunction with the copolymer (b). In the formula (I), $X_1$ and $X_2$ preferably are independently a hydrogen atom, an alkyl group having 1–3 carbon atoms, a nitro group or a halogen atom, $R_1$ and $R_2$ preferably stand, independently from each other, a lower alkyl group having 1–8 carbon atoms or a halogen atom and $A^+$ preferably stands for proton, sodium ion, potassium ion, ammonium ion or mono-, di-, tri- or tetraalkylammonium ion.

Illustrative of suitable azo compounds (a) are as follows:

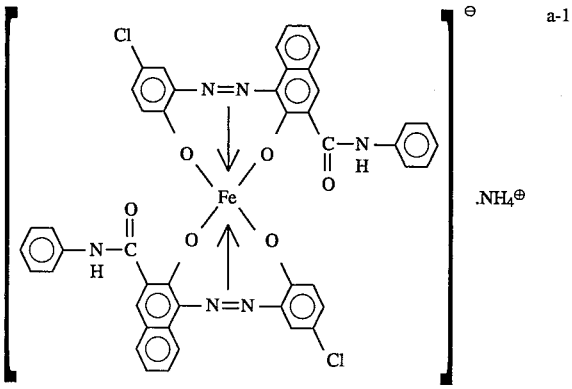

a-1

-continued a-2

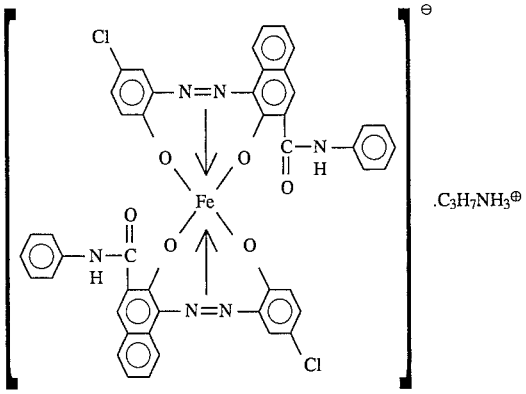

a-3

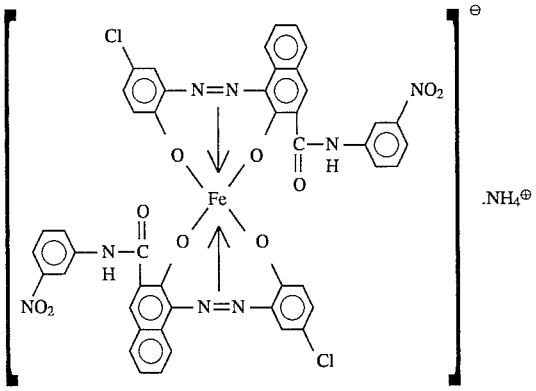

a-4

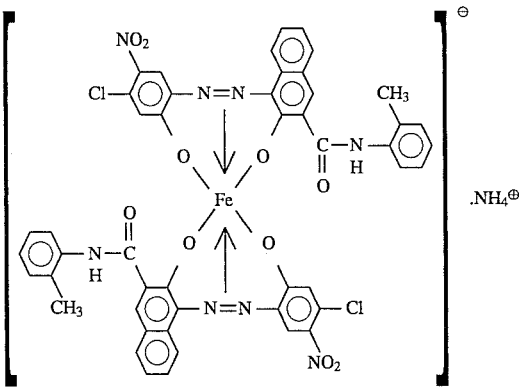

a-5

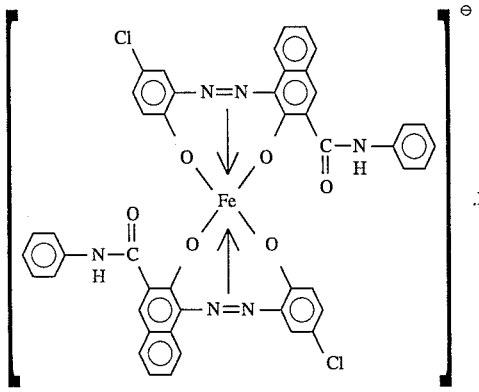

The copolymer (b) of a styrene monomer and/or an acrylic monomer with a sulfonic acid group-containing acrylamide preferably has a weight average molecular weight (hereinafter referred to as MW) of 2,000–50,000, more preferably 5,000–10,000. The amount of the sulfonic acid-containing acrylamide monomer in the copolymer (b) is preferably 0.1–20% by weight, more preferably 1–15% by weight. The acrylic monomer may be, for example, an alkyl acrylate or an alkyl methacrylate. The sulfonic acid group-containing acrylamide is preferably a compound expressed by the formula (II):

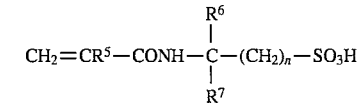

(II)

wherein $R^5$, $R^6$ and $R^7$ stand, independently from each other, for a hydrogen atom, a lower alkyl group having 1–8 carbon atoms, preferably 1–3 carbon atoms, or an aryl group and n is an integer of 1–15, preferably 1–8.

Examples of the copolymer (b) include (b-1) a copolymer (MW: 8,000) of 95 parts by weight of styrene with 5 parts by weight of 2-acrylamide-2-methylpropanesulfonic acid, (b-2) a copolymer (MW: 8,000) of 90 parts by weight of styrene with 10 parts by weight of 2-acrylamide-2-methylpropanesulfonic acid, (b-3) a copolymer (MW: 6,000) of 90 parts by weight of styrene with 10 parts by weight of 2-acrylamide-2-methylpropanesulfonic acid, (b-4) a copolymer (MW: 10,000) of 97 parts by weight of styrene with 3 parts by weight of 2-acrylamide-2-methylpropanesulfonic acid, (b-5) a copolymer (MW: 8,000) of 90 parts by weight of styrene, 5 parts by weight of butyl acrylate and 5 parts by weight of 2-acrylamide-2-methylpropanesulfonic acid, and (b-6) a copolymer (MW: 7,500) of 90 parts by weight of styrene, 5 parts by weight of tert-butyl methacrylate and 5 parts by weight of 2-acrylamide-2-methylpropanesulfonic acid.

The amount of the charge controlling agent composed of the azo compound (a) and the copolymer (b) varies with the kind of the binder resin, the kind of additives and the method of preparation of the toner. Generally, however, the azo compound (a) is used in an amount of 0.5–3 parts by weight, preferably 1–2 parts by weight, per 100 parts by weight of the binder resin. The copolymer (b) is used in an amount of 0.1–10 parts by weight, preferably 3–5 parts by weight, per 100 parts by weight of the binder resin.

The binder resin may be, for example, a homopolymer of styrene or a styrene derivative such as polystyrene, poly(p-chlorostyrene) or poly(vinyltoluene); a styrene copolymer such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene terpolymer, a styrene-maleic acid copolymer or a styrene-maleate copolymer; poly(methyl methacrylate); poly(butyl methacrylate); poly(vinyl chloride); poly(vinyl acetate); polyethylene; polypropylene, polyester; polyurethane; polyamide; an epoxy resin; poly(vinyl butyral); poly(acrylic acid); rosin; modified rosin; a terpene resin; an aliphatic or alicyclic hydrocarbon resin; an aromatic petroleum resin; chlorinated paraffin; or paraffin wax. These resins may be used by themselves or as a mixture of two or more.

Illustrative of suitable binder resins for use in fixation under a pressure are polyolefins such as low molecular weight polyethylene (MW: 1,000–5,000), low molecular weight polypropylene (MW: 1,000–5,000), oxidized polyethylene and poly(4-fluoroethylene); epoxy resins; polyesters, styrene-butadiene copolymers (monomer ratio: (5–30):(95-70)); olefin copolymers such as ethylene-acrylic acid copolymers, ethylene-acrylate copolymers, ethylene-methacrylic acid copolymers, ethylene-methacrylate copolymers, ethylene-vinyl chloride copolymers, ethylene-vinyl acetate copolymers and ionomer resins); and polyvinylpyrrolidones.

The polyesters may be those obtained by reaction of a polyhydric alcohol with a carboxylic acid. Examples of such alcohols include diols such as polyethylene glycol, diethylene glycol, triethylene glycol, 1,2-propylene glycol, 1,3-propylene glycol, 1,4-propylene glycol, neopentyl glycol and 1,4-butanediol; 1,4-bis (hydroxymethyl) cyclohexane; bisphenol compounds such as bisphenol A, hydrogenated bisphenol A and etherified bisphenols such as polyoxyethylene-substituted bisphenol A; above divalent alcohols substituted with a saturated or unsaturated hydrocarbyl group having 3–22 carbon atoms; and other polyhydric alcohols such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 1-methyl-1,2,4-butanetriol, trimethylolethane, trimethylolpropane and 1,3,5-trihydroxymethylbenzene.

Examples of the carboxylic acids include monocarboxylic acids such as palmitic acid, stearic acid and oleic acid; dicarboxylic acids such as maleic acid, fumaric acid, mesaconic acid, citraconic acid, hexanedicarboxylic acid, iraconic acid, glutaconic acid, phthalic acid, isophthalic acid, terephthalic acid, cylcohexanedicarboxylic acid, succinic acid, adipic acid, sebacic acid and malonic acid; above dicarboxylic acids substituted with a saturated or unsaturated hydrocarbyl group having 3–22 carbon atoms; anhydrides of the above dicarboxylic acids; a dimer of a lower alkyl ester with linolenic acid; tri- or higher polycarboxylic acids and anhydrides thereof such as 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane and a trimer of 1,2,7,8-octanetetracarboxylic acid.

Examples of epoxy resins include polycondensation products of bisphenol A and epichlorohydrin such as EPOMIC R362, R364, R365, R366, R367 and R369 (products of Mitui Petrochemical Inc.), EPOTOTO YD-011, YD-012, YD-014, YD-904 and YD-017 (products of Toho Kasei K. K.) and EPICOTE 1002, 1004 and 1007 (products of Shell Chemical Inc.).

Any known colorant may be used for the purpose of the invention. The colorant may be, for example, carbon black, lamp black, iron black, ultramarine, a nigrosine dye, aniline blue, phthalocyanine blue, phthalocyanine green, hansa yellow G, rhodamine 6G, lake, chalco oil blue, chrome yellow, quinacridone, benzidine yellow, rose bengal, a triarylmethane dye and a monoazo or bisazo dye or pigment. These colorants may be used by themselves or in combination with two or more.

The toner composition according to the present invention may contain one or more additives, if desired. Illustrative of additives are a lubricant such as tetrafluoroethylene or zinc stearate; an abrasive such as cerium oxide or silicon carbide; a flowability improving agent (caking-prevention agent) such as colloidal silica or aluminum oxide; an electrical conductivity-imparting agent such as carbon black or tin oxide; and fixation adjuvant such as a low molecular weight polyolefin.

The toner of the present invention may be prepared by any known method. For example, a mixture containing the above-described ingredients is heated to a temperature above the softening point of the binder resin and thoroughly mixed with a kneader. The kneaded mixture is then solidified, pulverized and sieved to obtain a toner product. The volume average particle diameter of the toner is generally 5–20 μm.

The thus obtained toner may be used as a magnetic toner. For this purpose, a magnetic material such as iron oxide (e.g. magnetite or hematite), metallic cobalt or nickel, an alloy of iron, cobalt and/or nickel with one or more metals such as aluminum, copper, lead, magnesium, tin, zinc, antimony, beryllium, bismuth, cadmium, calcium, manganese, selenium, titanium, tungsten and vanadium, is incorporated into the toner. The magnetic material preferably has an average particle diameter of 0.1–2 μm and preferably used in an amount of 20–200 parts by weight, more preferably 40–150 parts by weight, per 100 parts by weight of the binder resin of the toner.

The toner of the present invention is suitably used as a two-component-type developing system in conjunction with carrier particles which may be (a) magnetic particles such as of metals, compounds and alloys of iron, cobalt and nickel, (b) glass beads or (c) composite particles composed of the above magnetic particles or glass beads each coated with a layer of a resin.

Very good results are obtainable when the toner is used together with carrier particles each composed of base particles and a surface layer covering each of the base particles and containing a silicone resin, electroconductive particles and a silane coupling agent. The base particles may be magnetic particles or glass beads. The magnetic particles may be metals, compounds and alloys of iron, cobalt and nickel, such as iron powder, nickel powder, cobalt powder, ferrite powder, hematite powder or magnetite powder. The base particles generally have an average particle diameter of 10–1,000 μm, preferably 30–50 μm.

Any silicone resin may be suitably used for the purpose of the present invention. Illustrative of silicone resins are KR261, KR271, KR272, KR275, KR280, KR282, KR285, KR251, KR155, KR220, KR201, KR204, KR205, KR206, SA-4, ES1001, ES1001N, ES1002T and KR3093 (products of Shinetsu Silicone Inc.) and SR2100, SR2101, SR2107, SR2110, SR2108, SR2109, SR2115, SR2400, SR2410, SR2411, SH805, SH806A and SH840 (products of Toray Dow Corning Silicone Inc.). The silicone resin is used in an amount of 1–10% based on the weight of the base particles.

The electrically conductive particles may be, for example, carbon black, contact black, furnace black or thermal black. Carbon black is particularly suitably used. The conductive particles preferably have an average particle diameter of 0.01–5.0 μm and preferably used in an amount of 0.01–30 parts by weight, more preferably 0.1–20 parts by weight, per 100 parts by weight of the silicone resin.

The silane coupling agent is preferably a compound expressed by the formula:

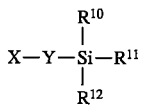

wherein X is an amine-containing group, Y is an alkylene group preferably having 1–5 carbon atoms and $R^{10}$, $R^{11}$ and $R^{12}$ stand, independently from each other, an organic group with the proviso that at least $R^{10}$ and $R^{11}$ are hydrolyzable. Preferably, $R^{10}$ and $R^{11}$ are each a substituted or non-substituted alkoxyl group or an acyloxyl group, such as a methoxy group, an ethoxy group or an acetoxy group. $R^{12}$ is preferably the same as $R^{10}$ or an alkyl group. The amine contained in the group X may be primary, secondary or tertiary amine.

Illustrative of suitable silane coupling agents are γ-(2-aminoethyl)aminopropyltrimethoxysilane, γ-(2-aminoethyl)aminopropylmethyldimethoxysilane, γ-anilinopropyltrimethoxysilane and octadecyldimethyl-[3-(trimethoxysilyl)propyl]ammonium chloride. The silane coupling agent is generally used in an amount of 0.1–10 parts by weight, preferably 0.2–5 parts by weight, per 100 parts by weight of the silicone resin.

The surface layer containing the silicone resin, conductive particles and silane coupling agent may be formed on the surfaces of base particles by spraying a dispersion containing the silicone resin, the conductive particles and the silane coupling agent over the surfaces of the base particles or by immersing the base particles in the dispersion. To form the dispersion (coating liquid), the silicone resin is dissolved in a suitable solvent and the resulting solution is used as a dispersing medium.

The following examples will further illustrate the present invention. Parts are by weight.

Preparation of Carrier

| Carrier A: | |
|---|---|
| Silicone resin (KR206 manufactured by Shinetsu Silicone Inc.) | 100 parts |
| Carbon black (#44 manufactured by Mitsubishi Chemical Industry Inc.) | 3.5 parts |
| Toluene | 100 parts |

The above composition was mixed with a mixer for 30 minutes to form a dispersion. The dispersion was charged into a fluidized bed-type coating device together with 1,000 parts of ferrite particles having an average particle diameter of 100 μm. The ferrite particles thus coated were dried to obtain Carrier A.

| Carrier B: | |
|---|---|
| Silicone resin (SR2400 manufactured by Toray Dow Corning Silicone Inc.) | 100 parts |
| Tin oxide (S-1 manufactured by Mitsubishi Metal Inc.) | 2 parts |
| Toluene | 100 parts |
| **Carrier C:** | |
| Silicone resin (SR2400 manufactured by Toray Dow Corning Silicone Inc.) | 100 parts |
| Carbon black (KETCHEN BLACK manufactured by Lion Akzo Inc.) | 1.5 parts |
| γ-anilinopropyltrimethoxysilane (SZ6083 manufactured by Toray Dow Corning Inc.) | 0.3 part |
| Toluene | 100 parts |
| **Carrier D:** | |
| Silicone resin (KR206 manufactured by Shinetsu Silicone Inc.) | 100 parts |
| Carbon black (#3600 manufactured by Mitsubishi Chemical Industry Inc.) | 1 part |
| γ-(2-aminoethyl)aminopropyltrimethoxysilane (SH6020 manufactured by Toray Dow Corning Inc.) | 0.1 part |
| Toluene | 100 parts |
| **Carrier E:** | |
| Silicone resin (KR206 manufactured by Shinetsu Silicone Inc.) | 100 parts |
| Carbon black (#44 manufactured by Mitsubishi Chemical Industry Inc.) | 1.5 parts |
| γ-(2-aminoethyl)aminopropyltrimethoxysilane (SH6020 manufactured by Toray Dow Corning Inc.) | 0.4 part |
| Toluene | 100 parts |

Each of the above compositions was mixed with a mixer for 30 minutes to form a dispersion. The dispersion was charged into a fluidized bed-type coating device together with 1,000 parts of ferrite particles having an average particle diameter of 70 μm. The ferrite particles thus coated were dried to obtain Carriers B-E.

EXAMPLE 1

| | |
|---|---|
| Polyester resin (LUNAPALE 1447 manufactured by Arakawa Chemical Inc.) | 100 parts |
| Carbon black | 10 parts |
| Azo dye (a-1) | 1.5 parts |
| Copolymer (b-1) | 2 parts |

The above composition was thoroughly mixed with a Henschel mixer and then kneaded at a temperature of 130°–140° C. for about 30 minutes with a roll mill. The kneaded mixture was cooled to room temperature, ground and sieved to obtain a black toner (Toner A) having a particle diameter of 5–20 μm. Toner A was found to have an azo dye content $C_A$ of $7.4\times10^{-3}$ (g/g).

Toner A (2.5 parts) was mixed with 97.5 parts of Carrier A using a ball mill to obtain a developer. The developer was charged in a copying machine (FT6960L manufactured by Ricoh Company, Ltd.). The copying machine was continuously operated to obtain 120,000 copies. Excellent images were found to be obtained throughout the continuous copying operation. The measurement of charges on the toner by the blow-off method gave −19.1 μC/g and −20.2 μC/g before and after the copying operation, respectively. No toner filming was caused on the photosensitive medium. The toner was found to have a minimum fixing temperature of 120° C. and a penetration of 18 mm.

The minimum fixing temperature and the penetration were measured by the following methods.

Minimum fixing temperature:

Copies are produced, using a copying machine (IMADIO Mf530 manufactured by Ricoh Company, Ltd.) charged with sample developer, at various fixing temperatures while maintaining the image density (with a McBeath densitometer) at 1.2. Each copy is then rubbed 10 times with a sand rubber eraser mounted on a clock meter and the image density ($D_1$) is measured with the McBeath densitometer. Fixation is then calculated according to the following equation:

$$Fixation\ (\%)=D_1/D_0\times100$$

where $D_0$ is the density before rubbing (namely $D_0$=1.2). The minimum fixing temperature of the developer is the minimum temperature above which the fixation is greater than 70%.

Penetration:

Sample toner is filled in a glass vessel and placed in a thermostatic chamber at 60° C. for 4 hours. The contents in the vessel was cooled to 24° C. and subjected to the penetration test in accordance with JIS (Japanese Industrial Standards) K 2235 1991. The greater the penetration, the better is the preservability of the toner at an elevated temperature.

COMPARATIVE EXAMPLE 1

Example 1 was repeated in the same manner as described except that Copolymer (b-1) was not used at all. While clear images were obtained in initial stage of the copying operation, fog was caused after about 30,000 copies. A toner filming phenomenon was caused on the photosensitive surface. The charge was initially −16.3 μC/g but was reduced to −10.9 μC/g after 30,000 copying operation.

COMPARATIVE EXAMPLE 2

Example 1 was repeated in the same manner as described except that Azo dye (a-1) was not used at all. Images obtained were fogged and were unclear.

COMPARATIVE EXAMPLE 3

Example 1 was repeated in the same manner as described except that the amount of Azo dye (a-1) was increased to 2.5 parts. Toner B thus obtained was found to have an azo dye content $C_A$ of $21\times10^{-3}$ (g/g). While clear images were obtained in initial stage of the copying operation, fog was caused after about 50,000 copies. A toner filming phenomenon was caused on the photosensitive surface. The charge was initially −20.9 μC/g but was reduced to −9.9 μC/g after 50,000 copying operation.

COMPARATIVE EXAMPLE 4

Example 1 was repeated in the same manner as described except that the amount of Azo dye (a-1) was decreased to 1 part. Toner C thus obtained was found to have an azo dye content $C_A$ of $6.1\times10^{-3}$ (g/g). The copy reproduction test revealed that the copies were fogged and had unclear images.

EXAMPLE 2

| | |
|---|---|
| Styrene/2-ethylhexyl acrylate copolymer | 100 parts |
| Polypropylene | 5 parts |
| Carbon black | 10 parts |
| Azo dye (a-1) | 1.5 parts |
| Copolymer (b-2) | 2 parts |

The above composition was mixed, kneaded, solidified, ground and sieved in the same manner as that in Example 1 to obtain a black toner (Toner D) having a particle diameter of 5–25 μm. Toner D was found to have an azo dye content $C_A$ of $16.5\times10^{-3}$ (g/g).

Toner D (2.5 parts) was mixed with 97.5 parts of Carrier C using a ball mill to obtain a developer. The developer was then tested in the same manner as that in Example 1. Excellent images were found to be obtained throughout the continuous 150,000 copying operation. The measurement of charges on the toner by the blow-off method gave −23.2 μC/g and −21.5 μC/g before and after the copying operation, respectively. No toner filming was caused on the photosensitive medium. The toner was found to have a minimum fixing temperature of 140° C. and a penetration of 10 mm.

EXAMPLE 3

Example 2 was repeated in the same manner as described except that Carrier D was substituted for Carrier C. The developer was then tested in the same manner as that in Example 1. Excellent images were found to be obtained throughout the continuous 180,000 copying operation. The measurement of charges on the toner by the blow-off method gave −25.1 μC/g and −22.0 μC/g before and after the copying operation, respectively. No toner filming was caused on the photosensitive medium.

EXAMPLE 4

| | |
|---|---|
| Polyester resin (LUNAPALE 1447 manufactured by Arakawa Chemical Inc.) | 100 parts |
| Polypropylene | 5 parts |
| Carbon black | 10 parts |
| Azo dye (a-1) | 2 parts |
| Copolymer (b-2) | 2 parts |

The above composition was thoroughly mixed with a Henschel mixer and then kneaded at a temperature of 130°–140° C. for about 30 minutes with a roll mill. The kneaded mixture was cooled to room temperature, ground and sieved to obtain a black toner having a particle diameter of 5–20 μm. This toner (100 parts) was mixed with 3 parts of silicon carbide (average particle diameter: 2 μm) and 0.1 part of hydrophobic colloidal silica to obtain Toner E. Toner E was charged in a developing section (arranged for use with a developer of a one-component type system) of a copying machine as shown in FIG. 1 and the copying machine was continuously operated to obtain 50,000 copies. Excellent images were found to be obtained throughout the continuous copying operation.

Referring to FIG. 1, designated as 7 is a toner tank containing a toner 6 which is continuously forcibly moved toward a sponge roller 4 by rotation of a stirring wheel 5 disposed in the tank 7. The toner 6 is then transferred to a toner conveying roller 2 by rotation of the sponge roller 4, where the toner is electrostatically adsorbed on the conveying roller 2 by frictional contact between the sponge roller and the conveying roller 2. Designated as 3 is an elastic blade disposed in contact with the toner layer formed on the conveying roller 2, so that the thickness of the toner layer on the conveying roller 2 is made uniform and the toner layer is charged by the frictional contact with the blade 3. The toner layer is then fed to an electrostatic latent image-bearing roller 1 disposed adjacent to the conveying roller 2, so that the latent image formed by exposure is developed to form a toner image.

To determine the specific charge Q/M of the toner on the toner conveying roller 2, a part of the toner was trapped with a Faraday cage by suction through a filter. The specific charge was found to be −13.8 μC/g, indicating that the toner was satisfactorily charged. The specific charge after 50,000 copying operation was −10.9 μC/g. Similar measurements were carried out at high and low humidity conditions to reveal that the initial specific charges were −10.5 μC/g and −12.6 μC/g, respectively. No toner filming was caused on the photosensitive medium 1, elastic blade 3 or toner conveying roller 2. The toner was found to have a minimum fixing temperature of 117° C. and a penetration of 20 mm.

EXAMPLE 5

| | |
|---|---|
| Epoxy resin | 100 parts |
| Carbana wax (melting point: 83° C.) | 5 parts |
| Carbon black | 8 parts |
| Azo dye (a-1) | 1 part |
| Copolymer (b-3) | 5 parts |

The above composition was thoroughly mixed with a Henschel mixer and then kneaded at a temperature of 130°–140° C. for about 30 minutes with a roll mill. The kneaded mixture was cooled to room temperature, ground and sieved to obtain a black toner (Toner F) having a particle diameter of 5–20 μm. Toner F was found to have an azo dye content $C_A$ of $8.3\times10^{-3}$ (g/g).

Toner F (2.5 parts) was mixed with 97.5 parts of Carrier E using a ball mill to obtain a developer. The developer was charged in a copying machine (FT6960L manufactured by Ricoh Company, Ltd.). The copying machine was continuously operated to obtain 180,000 copies. Excellent images were found to be obtained throughout the continuous copying operation. The measurement of charges on the toner by the blow-off method gave −26.1 μC/g and −25.3 μC/g before and after the copying operation, respectively. No toner filming was caused on the photosensitive medium. The toner was found to have a minimum fixing temperature of 110° C. and a penetration of 20 mm.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A negatively chargeable toner for developing an electrostatic image, comprising a polyester resin obtained by reaction of a polyhydric alcohol with a carboxylic acid as binder resin, a colorant, and a charge controlling agent including (a) an iron-containing azo dye expressed by the following general formula (I):

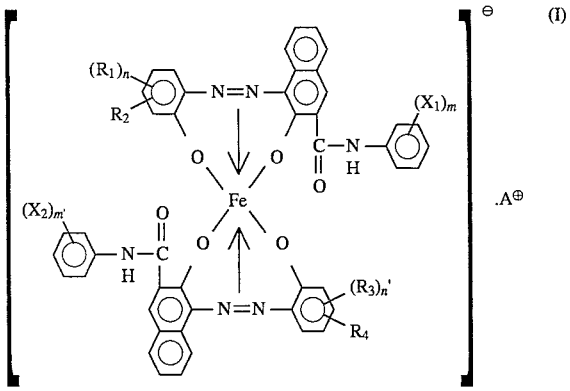

(I)

wherein $X_1$ and $X_2$ are independently selected from the group consisting of a hydrogen atom, a lower alkyl group, an alkoxy group, a nitro group, and a halogen atom, $R_1$ and $R_3$ are independently selected from the group consisting of a hydrogen atom, an alkyl group having 1–18 carbon atoms, an alkenyl group, a sulfonamide group, an organic sulfonyl group, a carboxylic acid ester group, a hydroxyl group, an alkoxy group having 1–18 carbon atoms, an acetylamino group, and a halogen atom, $R_2$ and $R_4$ are independently selected from the group consisting of a hydrogen atom, and a nitro group, A® stands for a cation, and m, m', n and n' are each an integer of 1–3, and (b) a copolymer of a styrene monomer and/or an acrylic monomer with a sulfonic acid group-containing acrylamide, wherein the amount of said azo dye present on the surface of said toner is $7\times10^{-3}$ to $20\times10^{-3}$ g per 1 g of said toner.

2. The toner of claim 1, wherein $X_1$, $X_2$, $R_2$, and $R_4$ are each a hydrogen atom, $R_1$ and $R_3$ are each a chlorine atom, m, m', n and n' are each 1, and A® is an ammonium ion.

3. A toner as claimed in claim 1, wherein said azo dye is a compound of the formula (I), wherein $X_1$ and $X_2$ are independently selected from the group consisting of a hydrogen atom, an alkyl group having 1–3 carbon atoms, a nitro group, and a halogen atom, $R_1$ and $R_2$ are independently selected from the group consisting of a lower alkyl group having 1–8 carbon atoms, and a halogen atom, and A® is selected from the group consisting of proton, sodium ion, potassium ion, ammonium ion or mono-, di-, tri-, and tetra-alkylammonium ion.

4. A toner as claimed in claim 1, wherein said sulfonic acid group-containing acrylamide of said copolymer is a compound expressed by the formula (II):

$$CH_2{=}CR^5{-}CONH{-}\overset{\overset{R^6}{|}}{\underset{\underset{R^7}{|}}{C}}{-}(CH_2)_n{-}SO_3H \qquad \text{(II)}$$

wherein $R^5$, $R^6$ and $R^7$ are independently selected from the group consisting of a hydrogen atom, a lower alkyl group having 1–8 carbon atoms, and an aryl group, and n is an integer of 1–15.

5. A developing composition comprising a tonor according to claim 1, and carrier particles each having a surface layer containing a silicone resin, electroconductive particles and a silane coupling agent.

6. A developing composition as claimed in claim 5, wherein said silane coupling agent is a compound expressed by the formula:

$$X{-}Y{-}\overset{\overset{R^{10}}{|}}{\underset{\underset{R^{12}}{|}}{Si}}{-}R^{11}$$

wherein X is an amine-containing group, Y is an alkylene group and $R^{10}$, $R^{11}$ and $R^{12}$ are independently an organic group, with the proviso that at least $R^{10}$ and $R^{11}$ are hydrolyzable.

7. The toner of claim 4, wherein said sulfonic acid group-containing acrylamide is 2-acrylamide-2-methylpropanesulfonic acid.

8. The developing composition of claim 6, wherein the silane coupling agent is γ-anilinopropyltrimethoxysilane or γ-(2-aminoethyl)aminopropyltrimethoxysilane.

* * * * *